US011858776B2

(12) United States Patent
Shmaiser et al.

(10) Patent No.: US 11,858,776 B2
(45) Date of Patent: Jan. 2, 2024

(54) SHEET CONVEYING APPARATUS

(71) Applicant: HIGHCON SYSTEMS LTD., Yavne (IL)

(72) Inventors: Aron Shmaiser, Rishon le Zion (IL); Nuriel Amir, Yokneam Illit (IL)

(73) Assignee: HIGHCON SYSTEMS LTD., Yavne (IL)

( * ) Notice: Subject to any disclaimer, the term of this patent is extended or adjusted under 35 U.S.C. 154(b) by 3 days.

(21) Appl. No.: 17/785,559

(22) PCT Filed: Oct. 21, 2021

(86) PCT No.: PCT/IL2021/051251

§ 371 (c)(1),
(2) Date: Jun. 15, 2022

(87) PCT Pub. No.: WO2022/091079

PCT Pub. Date: May 5, 2022

(65) Prior Publication Data

US 2023/0009594 A1 Jan. 12, 2023

(30) Foreign Application Priority Data

Oct. 26, 2020 (GB) ..... 2016962

(51) Int. Cl.
*B65H 9/10* (2006.01)
*B65H 5/02* (2006.01)
(Continued)

(52) U.S. Cl.
CPC ..... *B65H 9/101* (2013.01); *B65H 5/025* (2013.01); *B65H 5/062* (2013.01); *B65H 5/36* (2013.01);
(Continued)

(58) Field of Classification Search
CPC ..... B65H 9/106; B65H 9/16; B65H 9/166
See application file for complete search history.

(56) References Cited

U.S. PATENT DOCUMENTS 7,404,557 B2 * 7/2008 Tada ..... B65H 9/06 271/226
8,752,696 B2 * 6/2014 Reidhaar ..... B65H 9/166 271/226
(Continued)

FOREIGN PATENT DOCUMENTS

JP 2019-021163 A 2/2019
JP 2019-119570 A 7/2019
WO WO-2014208845 A1 * 12/2014 ..... B65H 9/166

OTHER PUBLICATIONS

"Self Aligning Conveying Table/System", The Discovery Dispatch, Search Report, Jun. 14, 2022, pp. 1-12.
(Continued)

*Primary Examiner* — Patrick Cicchino
(74) *Attorney, Agent, or Firm* — Sughrue Mion, PLLC

(57) ABSTRACT

A conveying apparatus for feeding sheets into a processing apparatus is discloses which comprises a plurality of nips within which sheets are gripped and driven along a conveying direction towards the processing apparatus, each nip being defined between a respective drive wheel and an opposing reaction surface. The drive wheels are omniwheels configured to apply a frictional force to advance the sheets in the conveying direction while permitting free movement of the sheets in a direction transverse to the conveying direction, the reaction surfaces permitting free movement of the sheets in the transverse direction, and an elongate guide is arranged on one side of the conveying apparatus, to extend generally parallel to the conveying direction, the conveying apparatus being configured to urge conveyed sheets in the transverse direction into contact with
(Continued)

the guide. A control system is provided to move the guide generally in the transverse direction in dependence upon sensed fiducials on the conveyed sheets, to ensure correct alignment of the sheets in the transverse direction with respect to the processing apparatus.

19 Claims, 2 Drawing Sheets

(51) Int. Cl.
*B65H 5/06* (2006.01)
*B65H 5/36* (2006.01)
*B65H 9/16* (2006.01)

(52) U.S. Cl.
CPC ..... *B65H 9/16* (2013.01); *B65H 2404/147* (2013.01); *B65H 2404/15212* (2013.01); *B65H 2404/20* (2013.01); *B65H 2404/531* (2013.01)

(56) References Cited

U.S. PATENT DOCUMENTS

| | | | | |
|---|---|---|---|---|
| 8,764,008 | B2 * | 7/2014 | Otsuki | B65H 9/16 271/227 |
| 9,758,330 | B2 * | 9/2017 | Park | G07D 11/17 |
| 10,589,950 | B2 * | 3/2020 | Irizarry | B65H 85/00 |
| 10,717,616 | B2 | 7/2020 | Cardillo | |
| 2015/0284203 | A1 | 10/2015 | Terrero et al. | |
| 2019/0300314 | A1 | 10/2019 | Irizarry et al. | |
| 2019/0308834 | A1 * | 10/2019 | Linder | B41J 13/0018 |
| 2021/0240122 | A1 * | 8/2021 | Fujita | G03G 15/6591 |

OTHER PUBLICATIONS

International Search Report for PCT/IL2021/051251 dated, Jan. 26, 2022 (PCT/ISA/210).
Written Opinion of the International Searching Authority for PCT/IL2021/051251 dated Jan. 27, 2022 (PCT/ISA/237).

* cited by examiner

SHEET CONVEYING APPARATUS

CROSS REFERENCE TO RELATED APPLICATIONS

This application is a National Stage of International Application No. PCT/IL2021/051251 filed Oct. 21, 2021, claiming priority based on United Kingdom Patent Application No. 2016962.9 filed Oct. 26, 2020.

FIELD OF THE INVENTION

The present invention relates to a conveying apparatus for feeding sheets into a processing apparatus.

BACKGROUND

In the manufacture of cardboard packaging, it is common to start with blank sheets of cardboard onto which an image is printed while the sheets are still flat. The image serves to identify the brand and contents of the packaging and may include information such as ingredients and instructions for use. The printed sheets are subsequently fed into a processing apparatus where they are cut along some lines to permit parts of the sheet to be removed and scored or indented along other lines to enable the sheets to be folded into a desired three-dimensional configuration.

In order for the printing to be correctly aligned with the faces of the packaging after it has been cut and folded, it is important for the sheets to be fed to the processing apparatus in a predetermined position and with a predetermined orientation. Thus, if a belt conveying apparatus is used to feed the sheets to the processing apparatus, it is important to ensure correct lateral positioning and orientation of the printed matter on reaching the processing apparatus.

Sheet conveying apparatuses have been proposed for feeding sheets into a processing apparatus, comprising a plurality of nips within which sheets are gripped and driven along a first direction towards the processing apparatus, each nip being defined between a respective drive wheel and an opposing reaction surface, wherein the drive wheels are omni-wheels configured to apply a frictional force to advance the sheets in the first direction while permitting free movement of the sheets in a second direction transverse to the first direction. Three such sheet conveying apparatuses are discussed below.

US2019300314 discloses a gravity-assisted registration system suited to use in a printing device includes a transport member with a surface on which an associated sheet is translated in a process direction. The surface defines an angle with respect to horizontal in a cross-process direction. A registration wall, adjacent a lower end of the surface, forms a guide for registering the sheet. A drive mechanism drives at least one rotation mechanism, for translating sheet in the process direction, each rotation mechanism including at least one drive member with an axis of rotation parallel to the surface in the cross-process direction. Each drive member includes a sliding mechanism, at a periphery of the drive member, enabling the sheet to slide, under gravity, on the surface, toward the registration wall into an alignment position, in contact with the registration wall. The reliance on gravity in such a system presents difficulties when the processing apparatus requires the sheets to be horizontal.

JP2019/119570 discloses a paper sheet handling device having a conveyance path delivering and conveying paper sheets from first conveyance means whose conveyance speed is V1 to second conveyance means whose conveyance speed V2 is equal to or faster than the conveyance speed V1, inclination correcting conveyance means of predetermined conveyance speed Va slower than the conveyance speed V1 or faster than the conveyance speed V2 is provided between the first conveyance means and the second conveyance means. JP2019/119570 corrects the orientation of the sheets but does not ensure their correct positioning a directions transverse to the conveying direction.

JP2019021163 discloses a paper sheet handling apparatus having a conveying path for conveying paper sheets includes: at least one first omni-wheel provided on a conveying path so as to be in contact with paper sheets and driven to rotate in a conveying direction on a conveying surface; at least one second omni-wheel provided on the conveying path so as to be in contact with the paper sheet and driven to rotate in a direction perpendicular to the conveying direction; and shift means for correcting the position of the paper sheet in a direction perpendicular to the conveying direction by driving to rotate the first omni-wheels and the second omni-wheels while at least one of the first omni-wheel and at least one of the second omni-wheel are in contact with the bill.

OBJECT OF THE INVENTION

The present invention seeks to provide a conveying apparatus that is well suited to high-speed operation, for example 1.5 to 2 m/s, while being able to ensure correct orientation of sheets when they are introduced into the processing apparatus as well as their correct position is a direction transverse to the process direction.

SUMMARY OF THE INVENTION

In accordance with the present invention, there is provided a conveying apparatus as hereinafter set forth in Claim 1 of the appended claims.

The conveying apparatus of the present invention recognises that there may be variations between the positioning of the printed matter on the sheet and a fixed guide or registration surface, as proposed for example in US2019300314, would not always ensure correct alignment of cuts and fold lines made by the processing apparatus with the printed matter on the sheets. The invention therefore proposes adjustment of the position of the guide to suit each individual sheet depending on fiducials on the sheet.

In some embodiments, to allow for the possibility of the printed matter being inclined relative to an edge of the sheets, the inclination of the elongate guide relative to the conveying direction may be adjustable for each sheet to vary the orientation of the sheet with respect to the processing apparatus in dependence upon fiducial markings on the sheet.

In some embodiments, to allow for the possibility of the printed matter being inclined relative to an edge of the sheets the elongate guide may additionally be pivotable about an axis normal to the plane of the conveyed sheet to vary the orientation of the sheet with respect to the processing apparatus.

In some embodiments, the control system may be operative to retract the guide after correct alignment of each sheet in the transverse direction.

The term "free movement" is intended to signify that movement can take place when a force is applied while encountering a resistance that is significantly less than the applied force. For example, roller skates or ice skates are deemed to permit a skater free movement.

The term "omni-wheel" is used herein to refer to a wheel that has a series of rollers disposed around its perimeter, the rollers being rotatable about axes that extend transversely to the axis of rotation of the wheel and the circumferential spacing of the rollers being such that in each angular position of the wheel at least one roller contacts a plane tangential to the wheel. Because the point of contact between the wheel and a sheet being conveyed is formed by a roller, the wheel can apply a frictional force to drive the sheet in a direction tangential to the axis of rotation of the wheel but, because each roller can rotate about its own axis, little frictional resistance is met by any force acting on a sheet in a direction transverse to the direction in which it is driven.

Because the sheet is gripped between two surfaces at each nip, it is important that both surfaces, i.e. both the omni-wheel and the opposing reaction surface, should permit free transverse movement of the conveyed sheets.

Free movements relative to the reaction surface may be achieved in some embodiments by the reaction surface being a stationary surface that is provided with a low friction coating. In alternative embodiments, the reaction surface may be that of a belt, roller ball bearing or roller movable in the first direction with conveyed sheets and having a low friction coating. The low friction coating may in either case be of polytetrafluoroethylene.

In some embodiments, the reaction surface may be formed by a second omni-wheel. In this case, the omni-wheel serving to provide a reaction surface may either be a freewheeling idler wheel, or it may be driven at the same speed as the drive wheel but in the opposite sense.

The nips of the conveying apparatus of the invention allow the conveyed sheets to be driven in a first direction by frictional engagement while allowing them to be moved transversely by a lateral force, to ensure their correct alignment on introduction into the processing apparatus. In various embodiments of the invention, different techniques may be used to apply a lateral force to ensure that each sheet is urged against the elongate guide.

In some embodiments, the conveying apparatus may be inclined to the processing apparatus, so that all sheets drift towards the elongate guide as they are advanced by the conveying system towards the processing apparatus.

It is alternatively possible for the conveying apparatus and the processing apparatus to be generally aligned with one another and for one or more pusher members to be provided to contact the lateral edge of each conveyed sheet opposite the edge to be urged against the elongate guide.

In further embodiments, in which the conveying apparatus and the processing apparatus are generally aligned with one another, at least one further nip may be provided between a transversely oriented omni-wheel serving to drive conveyed sheet in the transverse direction and a reaction surface that permits free movement of the sheets in the conveying direction.

BRIEF DESCRIPTION OF THE DRAWINGS

The invention will now be described further, by way of example, with reference to the accompanying drawings, in which.

DETAILED DESCRIPTION OF THE EMBODIMENTS

Figure 1:
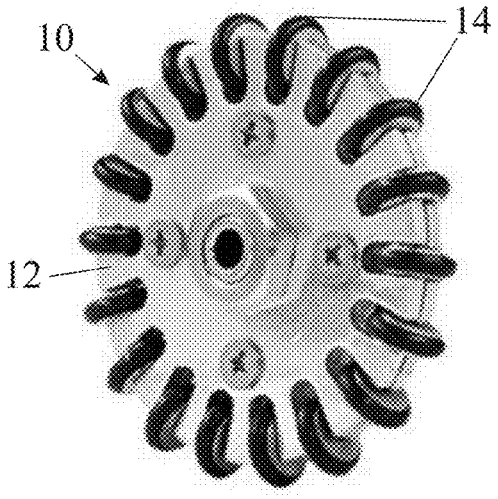
FIGS. 1 and 2 show different known designs of omni-wheels.

FIG. 1 shows a perspective view of a known omni-wheel. The omni-wheel 10 comprises a hub 12 rotatable about the axis of rotational symmetry of the wheel 10. A single row of ring-shaped rollers 14 is mounted around the perimeter of the hub 12. Each roller 14 is rotatable about an axis that lies in the plane of the hub 12 and is perpendicular to the radius of the wheel. The circumferential spacing of the rollers 14 is such that a plane tangential to the omni-wheel will always contact at least one of the rollers 14.

In any angular position, the omni-wheel can apply a frictional drive force to a sheet with which it is in contact, to advance the sheet along a line lying in the plane of the hub and extending tangentially to the wheel. However, while frictionally engaged with a sheet being conveyed, each roller 14 can rotate about its own axis to permit the sheet to move freely parallel to the rotational axis of the omni-wheel 10.

Figure 2:
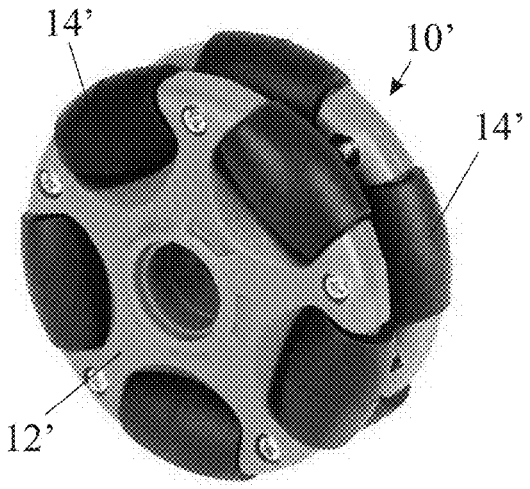

FIG. 2 shows a second known design of omni-wheel. In this case, the omni-wheel 10' has a hub 12' that supports two rows of rollers 14', that are axially offset from one another. In this case, the rollers are barrel-shaped, instead of being ring-shaped, and because they are on axially staggered rows, the rollers can circumferentially overlap one another to ensure that a sheet in contact with the perimeter of the wheel 10' will at all times being in contact with at least of the rollers 14'.

It should be made clear that the invention is not restricted to any particular design of omni-wheel, and it is, for example, possible to use omni-wheels in which the axes of the rollers do not lie in the plane of the hub.

Figure 3:
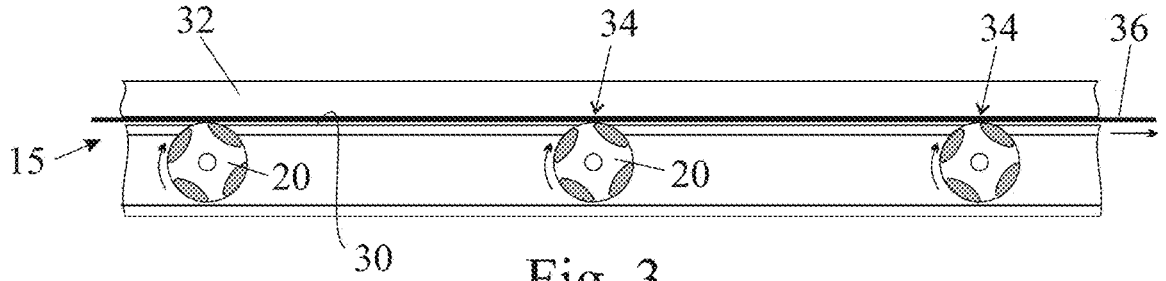
FIG. 3 to 5 show sections through three embodiments of a conveying apparatus of the invention having different forms of reaction surface at each nip.
Figure 4:
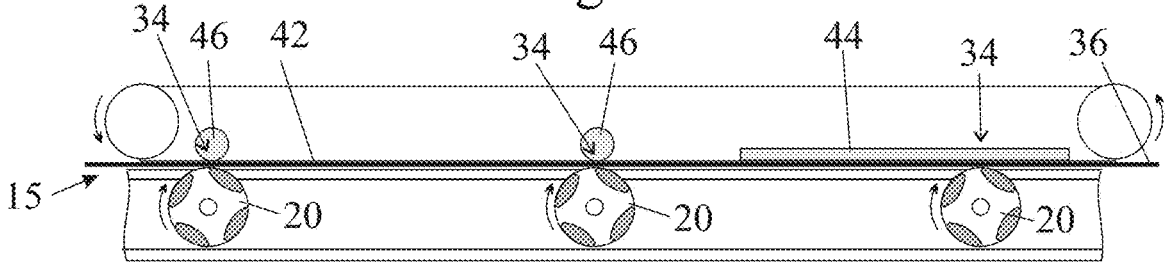
Figure 5:
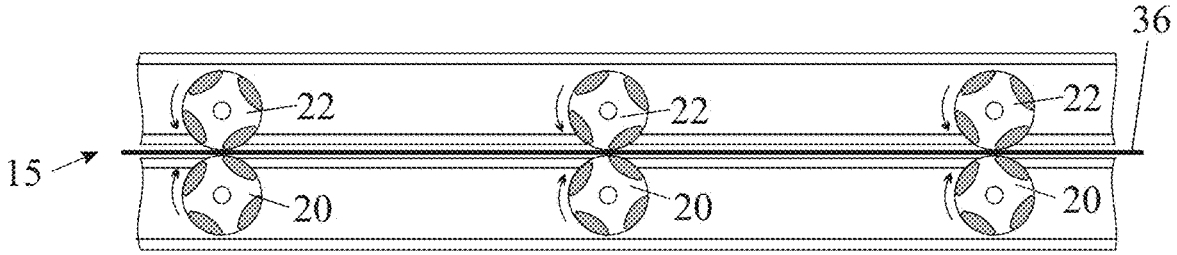

The conveying apparatus 15 shown in FIGS. 3 to 5 have horizontal beds 30 with slots through which sets of omni-wheels 20 partially protrude. In the embodiment of FIG. 3, a stationary pressure plate 32 having a low friction coating, such as PTFE, presses down on the bed 30 to define three sets of nips 34 at which sheets 36 to be conveyed to a processing apparatus (not shown) are gripped. Three sets of nips 34 are shown in the drawing but the total number of nips, the number of nips within each set and their mutual separation are parameters that may be varied, depending for example on the size of the conveyed sheets. With the omni-wheels 30 rotating clockwise, as represented by arrows in FIG. 3, the sheets are advanced by friction from left to right in the drawing. However, the sheets are free to move in a direction normal to the plane of the drawing by rotation of the rollers of the omni-wheels 20 and sliding relative to the PTFE coated surface of the pressure plate 32.

The beds 30 and the omni-wheels 20 in the embodiments of FIGS. 4 and 5 are the same as in FIG. 3 and have been allocated the same reference numerals. These embodiments differ from that of FIG. 3 in the manner in which the sheets 36 are pressed against the omni-wheels 20 at the nips 34. In FIG. 4, the reaction surface at each nip 34 is formed by a recirculating belt 42 that may have a low friction coating and is driven at the same surface speed as the omni-wheels 20. At each nip 34, the belt 42 is urged towards the omni-wheel 20 either by a stationary plate 44 or an idler roller 46. This embodiment offers the advantage that there is no slip between the sheets and the reaction surface at each nip when the sheets are being advanced towards the processing apparatus, slip only taking place during small transverse movements that may be needed for correct alignment. The same advantage can be achieved by using a PTFE coated roller at each nip.

In the embodiment of FIG. 5, the reaction surface at each nip is provided by a second omni-wheel 22 which may either freewheel or be driven at the same speed as the omni-wheel 20 but in the opposite sense. In this embodiment, there is no relative slip at the nip between the sheets 36 and either of the nip surfaces.

It is preferred to maintain rolling contact rather than slipping contact between the sheets and the reaction surface as slipping can mark the conveyed sheets either by smudging the print carried by the surface of the sheets or by modifying the surface texture of the sheets, such as by polishing. Furthermore, slipping makes it harder to control accurate movement of the sheets.

The conveying apparatuses 15 shown in FIGS. 3 to 5 thus allow the sheets to be advanced towards the processing apparatus by means of friction but to move laterally without encountering significant frictional resistance.

Figure 6:
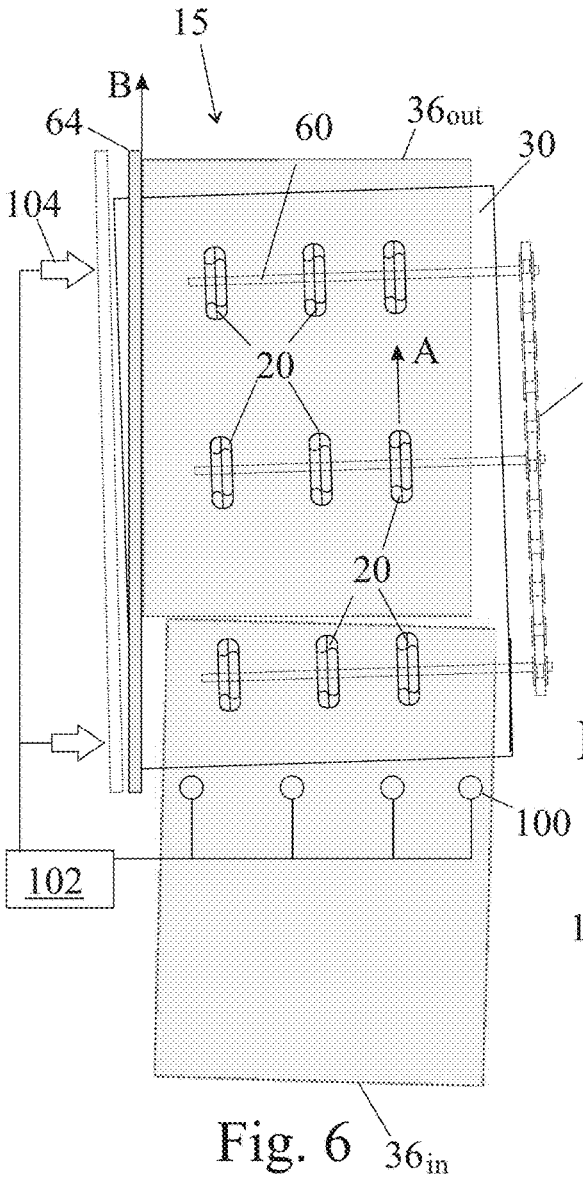
FIG. 6 is a plan view of the bed of an embodiment of the invention in which sheets are aligned by being drive towards an elongate guide inclined to the travel direction of the conveying apparatus.
Figure 7:
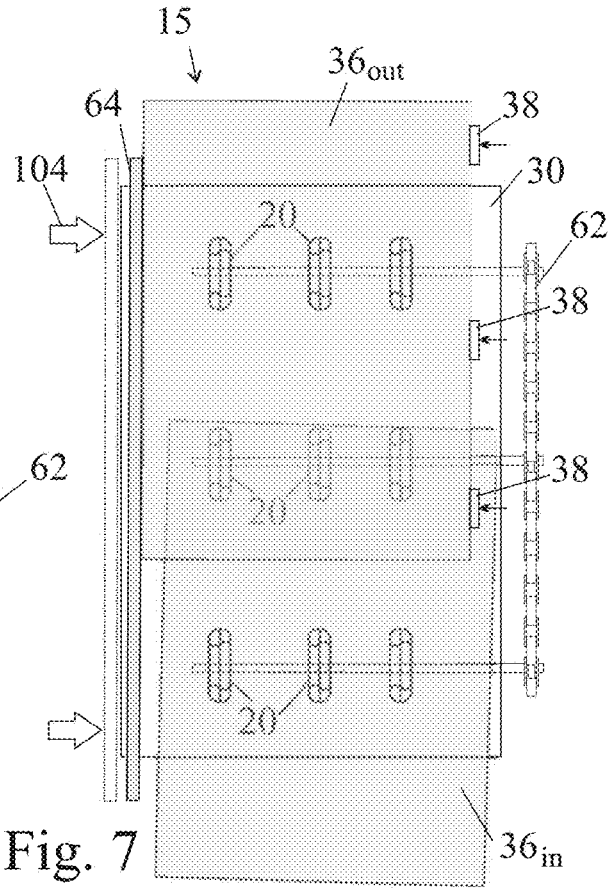
FIG. 7 is a plan view of the bed of an embodiment of the invention in which sheets are aligned by being pushed against an elongate guide by means of pusher members or joggers.
Figure 8:
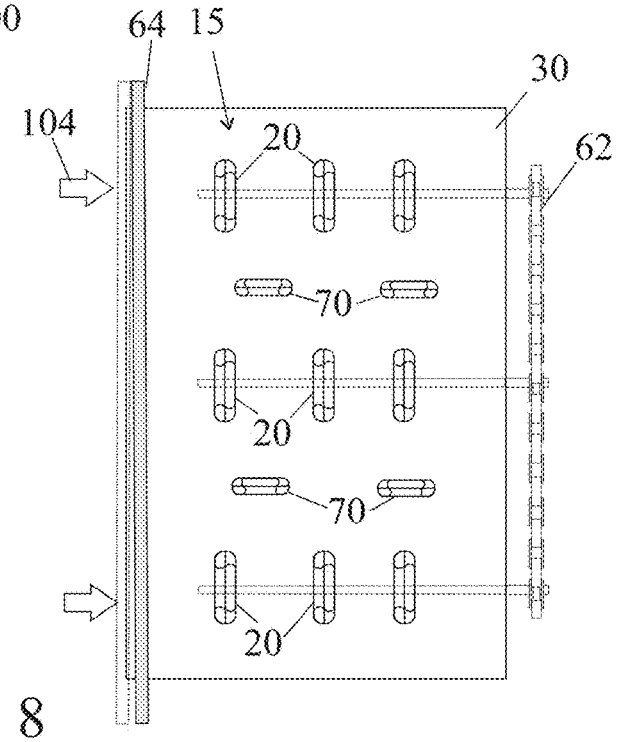
FIG. 8 is a plan view of the bed of an embodiment of the invention in which sheets are aligned by being pushed against an elongate guide by means of transversely oriented omni-wheels.

The purpose of being able to move the sheets laterally is to be able to urge them against an elongate lateral guide 64, shown in FIGS. 6, 7 and 8, serves to position each sheet so that printed matter on the sheet is aligned for correct registration with the cuts, creases and folds to be made by the processing apparatus.

Three different ways of urging the sheets against the elongate lateral guide are represented schematically FIGS. 6, 7 and 8, which show plan views of only the beds 30 of the conveying apparatus.

FIG. 6 shows schematically how, in order to align and position a sheet on the conveyor, the guide 64 may commence in a different position (shown in dotted lines) and actuators represented by arrows may displace and rotate the guide 64 to its final position, shown in solid lines, in which the sheet is correctly positioned and oriented to enter the processing apparatus. As described in more detail below, the movement of the guide 64 is controlled in dependence upon the position and orientation of the printed matter on each sheet at its time of arrival on the conveyor, as is determined using suitable sensors.

In each of FIGS. 6, 7 and 8 the bed 30 of the conveying apparatus 15 has three sets of omni-wheels 20 staggered from one another in the direction of travel, each set comprising three omni-wheels mounted on a common shaft 60. The shafts 60 are fitted with sprockets so that they may all be rotated in synchronism by means a drive chain 62. The number wheels in each set and the number of sets will naturally depend on the size of the conveying apparatus 15. Alternatively, the omni-wheels may be independently driven (by electrical motor) and the movement coordinated by a suitable controller.

In the embodiment of FIG. 6, the sheets are advanced along the conveying apparatus 15 in a direction represents by an arrow designated A at a slight angle to the direction along which they are desired to travel when passing towards the processing apparatus, which is represented by an arrow designated B. This angle may be less than 30°, or less than 10°, or less than 5°. Along one side of the bed 30 of the conveying apparatus 15, there is positioned an elongate guide 64.

Because of the inclination of the guide 64 relative to the conveying apparatus 15, sheets advanced by the omni-wheels 20 are made to collide, and align themselves, with the guide 64. Thus, a sheet arriving at the conveying apparatus 15, for example, in the position and orientation represented by the sheet designated $\mathbf{36}_{in}$ in FIG. 6, would leave the conveying apparatus 15 and enter the processing apparatus in the orientation and position represented by the sheet $\mathbf{36}_{out}$ in FIG. 6, having been displaced laterally by the inclined conveying apparatus 15 and caused to rotate counter-clockwise by collision with the guide 64.

The embodiment of FIG. 7 is better suited to situations where space considerations preclude mounting of the conveying apparatus 15 at an angle to the processing apparatus.

In this embodiment, the sheet 36 is urged against the correctly positioned elongate guide 64 by pusher members, or joggers 38 that acts on its opposite edge.

When the sheets 36 are narrower than the bed of the conveying apparatus, the joggers 38 may have the form of thin plates slidable between the bed 30 and the overlying reaction surface and moved or continually reciprocated in a direction transverse to the conveying direction by means of a suitable actuator, such as a solenoid. If the sheets 36 should be wider than the bed 30, then joggers 38 connected to a suitable actuator may be mounted to one side of the conveying apparatus 15. The force applied by the joggers 38 may be monitored and controlled to avoid any risk of damage to the sheets being conveyed. Such an alignment device will function correctly even when the width of the sheets is not constant.

The conveying apparatus 15 shown in FIG. 8 differs from that shown in FIG. 7 in that sheets are positively driven in a transverse direction by means of omni-wheels 70 that are mounted transversely to the omni-wheels 20. As with the omni-wheels 20, the omni-wheels 70 frictionally engage the sheets at respective nips, the reaction surface in this case allowing free movement in the conveying direction.

In FIG. 8, the omni-wheels 70 serve to drive the sheets towards the guide 64, which determines the position and orientation of the sheets on entering the processing apparatus. The omni-wheels 70 may in this case be driven continuously, whereupon they may be driven by the same motor as is used to drive the omni-wheels 20. For example, drive shafts extending transversely to the travel direction may be fitted with sprockets to engage the chain 62 and these shafts may drive the omni-wheels 70 through bevel gears or worm gears.

The omni-wheels 70 may alternatively be driven independently of the omni-wheels 20 and in such a case they may be driven only intermittently in order to prevent their slipping relative to the conveyed sheets. When a sheet being driven laterally by the omni-wheels 70 encounters resistance upon coming into contact with the guide 64, the load on the motor driving the omni-wheels 70 will increase and thereby vary the current drawn by the motor. Power to the motor driving omni-wheels 70 encountering resistance may be disconnected at this point to avoid slipping the omni-wheels 70 and the conveyed sheet.

Alternatively, omni wheels 70 can be continuously driven by their motors to urge sheets to come in contact with guide 64, but the torque of the motors will be limited so that when the sheet edge comes in contact with guide 64, the friction between the omni wheels 70 and the sheet will overcome the motors torque and stop them.

The elongate guide 64 in all three of the embodiments shown in FIGS. 6, 7 and 8 is movable by a control system 102 that is connected to sensors 100 and acts on actuators represented in the drawings by arrows 104.

The sensors 100 detect fiducials that are present on each printed sheet that allow the control system 102 to determine the position of the printed matter on each sheet relative to the lateral edge of the sheet to be urged against the elongate lateral guide 64. The fiducials may be printed markings that form part of the printed matter, but this need not necessarily be the case. They may for example be applied magnetic markings, indentations or holes made in the sheets made during the printing process. The fiducials may include elongate lines extending longitudinally or transversely, a series of individuals markings or any pattern that allows the control system to determine both the distance of the printed matter from the edge to the urged against the lateral guide 64 and also its orientation, if the printing happens to be askew on the sheet.

The inventors have found that using elongate fiducials or a series of fiducials stretching on the sheet in the desired conveying direction allows for real time or 'on the fly' monitoring of the position of the sheet and thereby for dynamic correction of the page positioning while being conveyed.

Having thus determined the position of the printing on the sheet, the control system 102 sends control signals to the actuators 104, which may for example be motors or linear actuators, to position the lateral guide 64 so that when the left hand edge of the each sheet 36 (as shown in the drawings) is urged against it, the printed matter is correctly positioned laterally and orientation to register with the cuts and folds to be made by the processing apparatus.

Sensors 100 may additionally or alternatively configured to determine the position of each sheet relative to the lateral edge of the sheet to be urged against the elongate lateral guide 64 the by detecting the location and/or the position of the edges (lateral and/or transversal) of each sheet. This method is useful when the sheet has elongate straight edges If the elongate guide 64 is inclined relative to the direction of movement of the sheet as it enters the processing apparatus, there is a possibility of the sheet being moved out of correct alignment. To avoid the elongate guide 64 interfering with the transverse position of the sheet after it has been correctly aligned with the processing machine, the control system 102 may retract the elongate guide 64 back to a rest position, shown in dotted lines in FIGS. 6 to 8.

While the invention has been described above by reference to specific embodiments, it will be clear to the person skilled in the art that various modifications may be made without departing from the scope of the invention as set out in the appended claims.

The invention claimed is:

1. A conveying apparatus for feeding sheets into a processing apparatus, comprising a plurality of nips within which sheets are gripped and driven along a conveying direction towards the processing apparatus, each nip being defined between a respective drive wheel and an opposing reaction surface, wherein the drive wheels are omni-wheels configured to apply a frictional force to advance the sheets in the conveying direction while permitting free movement of the sheets in a direction transverse to the conveying direction, the reaction surfaces permitting free movement of the sheets in the transverse direction, and an elongate guide is arranged on one side of the conveying apparatus, to extend generally parallel to the conveying direction, the conveying apparatus being configured to urge conveyed sheets in the transverse direction into contact with the guide, wherein a control system is provided to move the elongate guide generally in the transverse direction in dependence upon sensed fiducials on the conveyed sheets, to ensure correct alignment of the sheets in the transverse direction with respect to the processing apparatus, and wherein the conveying apparatus and the processing apparatus are generally aligned with one another, and one or more pusher members is/are provided to contact the lateral edges of the conveyed sheets opposite the edge to be urged against the elongate guide.

2. A conveying apparatus as claimed in claim 1, wherein, to allow for the possibility of the printed matter being inclined relative to an edge of a sheet, the inclination of the elongate guide relative to the conveying direction is adjustable for each sheet to vary the orientation of the sheet with respect to the processing apparatus in dependence upon sensed fiducials on the sheet.

3. A conveying apparatus as claimed in claim 1, wherein the control system is operative to retract the elongate guide after correct alignment of each sheet in the transverse direction.

4. A conveying apparatus as claimed in claim 1, wherein the reaction surfaces are formed by a belt, roller ball bearing or roller movable in the conveying direction and having a low friction coating.

5. A conveying apparatus as claimed in claim 4, wherein the low friction coating is of polytetrafluoroethylene.

6. A conveying apparatus as claimed in claim 1, wherein the reaction surface at each nip is formed by a second omni-wheel.

7. A conveying apparatus as claimed in claim 5, wherein the omni-wheel serving to provide a reaction surface is a freewheeling idler wheel.

8. A conveying apparatus as claimed in claim 5, wherein the omni-wheel serving to provide a reaction surface is driven at the same speed as the drive wheel.

9. A conveying apparatus as claimed in any claim 1, wherein, the conveying apparatus is inclined relative to the direction of movement of sheets within the processing apparatus, so that all sheets drift towards the elongate guide as they are advanced by the conveying system towards the processing apparatus.

10. A conveying apparatus for feeding sheets into a processing apparatus, comprising a plurality of nips within which sheets are gripped and driven along a conveying direction towards the processing apparatus, each nip being defined between a respective drive wheel and an opposing reaction surface, wherein the drive wheels are omni-wheels configured to apply a frictional force to advance the sheets in the conveying direction while permitting free movement of the sheets in a direction transverse to the conveying direction, the reaction surfaces permitting free movement of the sheets in the transverse direction, and an elongate guide is arranged on one side of the conveying apparatus, to extend generally parallel to the conveying direction, the conveying apparatus being configured to urge conveyed sheets in the transverse direction into contact with the guide, wherein a control system is provided to move the elongate guide generally in the transverse direction in dependence upon sensed fiducials on the conveyed sheets, to ensure correct alignment of the sheets in the transverse direction with respect to the processing apparatus, and wherein the conveying apparatus and the processing apparatus are generally aligned with one another, and at least one further nip is between a transversely oriented omni-wheel serving to drive conveyed sheet in the transverse direction and a reaction surface that permits free movement of the sheets in the conveying direction.

11. A conveying apparatus as claims in claim 1 wherein the control system is configured to move the elongate guide continuously generally in the transverse direction in dependence upon sensed elongate fiducials stretching on the conveyed sheets in the desired conveying direction, to ensure dynamically correct alignment of the sheets in the transverse direction with respect to the processing apparatus.

12. A conveying apparatus as claimed in claim 10, wherein, to allow for the possibility of the printed matter being inclined relative to an edge of a sheet, the inclination of the elongate guide relative to the conveying direction is adjustable for each sheet to vary the orientation of the sheet with respect to the processing apparatus in dependence upon sensed fiducials on the sheet.

13. A conveying apparatus as claimed in claim 10, wherein the control system is operative to retract the elongate guide after correct alignment of each sheet in the transverse direction.

14. A conveying apparatus as claimed in claim 10, wherein the reaction surfaces are formed by a belt, roller ball bearing or roller movable in the conveying direction and having a low friction coating.

15. A conveying apparatus as claimed in claim 14, wherein the low friction coating is of polytetrafluoroethylene.

16. A conveying apparatus as claimed in claim 10, wherein the reaction surface at each nip is formed by a second omni-wheel.

17. A conveying apparatus as claimed in claim 15, wherein the omni-wheel serving to provide a reaction surface is a freewheeling idler wheel.

18. A conveying apparatus as claimed in claim 15, wherein the omni-wheel serving to provide a reaction surface is driven at the same speed as the drive wheel but in the opposite sense.

19. A conveying apparatus as claimed in any claim 10, wherein, the conveying apparatus is inclined relative to the direction of movement of sheets within the processing apparatus, so that all sheets drift towards the elongate guide as they are advanced by the conveying system towards the processing apparatus.

* * * * *